US005417331A

United States Patent [19]

Takemoto et al.

[11] Patent Number: 5,417,331

[45] Date of Patent: May 23, 1995

[54] CONVEYANCE EQUIPMENT FOR PAPER OR THE LIKE, AND PAPER MONEY COLLECTION SYSTEM IN GAME ISLAND EMPLOYING THE SAME

[75] Inventors: Takatoshi Takemoto, Tokyo; Yoshihide Kurihara, Iwate; Koshiro Nakai, Iwate; Takashi Kan, Iwate; Noriaki Kano, Iwate; Eiji Ito, Iwate, all of Japan

[73] Assignee: Kabushiki Kaisha Ace Denken, Tokyo, Japan

[21] Appl. No.: 866,183

[22] PCT Filed: Sep. 9, 1991

[86] PCT No.: PCT/JP91/01199

§ 371 Date: Jun. 30, 1992

§ 102(e) Date: Jun. 30, 1992

[87] PCT Pub. No.: WO92/04264

PCT Pub. Date: Mar. 19, 1992

[30] Foreign Application Priority Data

Sep. 8, 1990 [JP] Japan ..... 2-238084

[51] Int. Cl.[6] ..... B07B 13/05

[52] U.S. Cl. ..... 209/682; 271/31.1

[58] Field of Search ..... 271/31.1, 272–274, 271/181; 209/682

[56] References Cited

U.S. PATENT DOCUMENTS 1,731,115 10/1929 Taylor ..... 209/682 X
4,333,640 6/1982 Miller ..... 271/274 X
4,705,266 11/1987 Sasage ..... 271/31.1 X
4,717,144 1/1988 Rosengren ..... 271/181 X

FOREIGN PATENT DOCUMENTS 47-42368 12/1972 Japan .
56-165644 12/1981 Japan .
60-119480 8/1985 Japan .
60-132784 9/1985 Japan .
60-190756 12/1985 Japan .
60-190760 12/1985 Japan .
60-244751 12/1985 Japan .
62-153049 7/1987 Japan .
62-124939 8/1987 Japan .
2235676 3/1991 United Kingdom .

*Primary Examiner*—D. Glenn Dayoan
*Attorney, Agent, or Firm*—Lowe, Price, LeBlanc & Becker

[57] ABSTRACT

In a conveyance equipment having a conveyance path which serves to convey paper or the like, and an introduction path which merges with the conveyance path, for guiding to the conveyance path the paper or the like to be introduced into the conveyance system, the paper or the like is conveyed in a state in which it is erected within the conveyance path while being sandwiched in between conveyance members; a conveyance equipment for paper or the like is so constructed that means for separating and excluding foreign matter is formed at a bottom of the conveyance path. Also, a paper money collection system in a game island is constructed using the conveyance equipment.

6 Claims, 5 Drawing Sheets

CONVEYANCE EQUIPMENT FOR PAPER OR THE LIKE, AND PAPER MONEY COLLECTION SYSTEM IN GAME ISLAND EMPLOYING THE SAME

TECHNICAL FIELD

The present invention relates to a conveyance equipment for conveying paper or the like, such as bank notes. More particularly, it relates to a conveyance equipment for paper or the like, which is installed in a game parlor for "pachinko" (a Japanese upright pinball game) and/or a slot machine game, or the like and which serves to convey bank notes from vending machines, which dispense a game medium, e.g., pachinko balls or gaming medals or coins, into a paper money receiving box. Further, the present invention relates to a paper money collection system in a game island which employs such a conveyance equipment.

BACKGROUND ART

In a game Parlor for "pachinko" and/or slot machine games, or the like, a plurality of game machines are aligned in two rows back to back, thereby forming a game island. Usually, in the game island, game medium vending machines for dispensing a game medium such as pachinko balls or gaming medals or coins are interposedly installed between the respectively adjacent game machines. A polisher for cleaning the game medium is mounted at the end of the game island. As a method of cleaning by the polisher, there has been known one wherein the game medium is polished up with an abrasive obtained by granulating a plastic material.

After having been polished up with the abrasive, the game medium is carried into the game island again so as to be reused in the game machines. In this regard, oily dust sometimes adheres to the game medium even after the polishing. Also, the game medium is sometimes carried to its passage in the game island while bearing the abrasive on account of electrostatic charges etc. stored in this game medium.

A conveyance equipment for conveying bank notes is arranged as a constituent of the island under such a game medium passage. In the conveyance equipment, a U-groove is formed in the base, and the bank note is conveyed along the U-groove into a paper money receiving box mounted at the end of the game island.

Since, however, the game medium passage includes diverging points etc. for replenishing the individual game machines and game medium vending machines with the game medium, the granular abrasive which adheres to the game medium is expelled out of the diverging points etc. to occasionally intrude into the conveyance path of the bank notes. Therefore, the conveyance equipment in the prior art might get clogged by the bank notes and has had the problem that, each time clogging ascribable to the bank notes occurs, a clerk in the game parlor must remove the abrasive, so labor is expended on the maintenance of the conveyance equipment.

An object of the present invention is to provide a conveyance equipment for paper or the like which can exclude an abrasive having intruded into a conveyance path for bank notes and can be prevented from getting clogged by the bank notes.

Besides, in a game island to which the present invention is applied, bank notes used in the game island are idetified while being collected.

Heretofore, in such a collection system, there has been known a structure wherein bank note identification machines are disposed in a state in which they are orthogonal to bank note conveyance belts, and wherein bank notes are conveyed into game fee receiving boxes by both the conveyance belts which are respectively extended unidirectionally along both the rows of game machines.

With such a structure, however, a conveyance equipment for the bank notes collides against the conduit or chute of a ball resupply device because it is attached to the part of a curtain board. In order to avoid the collision, the mounting position of the conduit or chute is shifted upwards. This measure, however, is unfavorable in design for the reason that the height of the island increases to inflict a sense of oppression on game players.

Another object of the present invention is to provide a paper money collection system in which, in order to eliminate the drawback as stated above, a conveyance equipment for bank notes is mounted outside a conduit or chute so as not to interfere with the conduit or chute, and in which identification machines are attached aslant or laterally so as to prevent an island from widening to the extent of mounting the conveyance equipment outside.

A further object is to provide a paper money collection system which is so constructed that an exchange machine for changing a large denomination note is installed on one end of an island, and that bank notes carried by conveyors are introduced into the large denomination note changing machine so as to be recycled for changing the money.

DISCLOSURE OF THE INVENTION

According to the present invention, there is provided, in a conveyance equipment having a conveyance path which serves to convey paper or the like, and an introduction path which merges with the conveyance path, for guiding to the conveyance path the paper or the like to be introduced into the conveyance system, wherein the paper or the like is conveyed in a state in which it is erected within the conveyance path while being sandwiched in between conveyance members; a conveyance equipment for paper or the like characterized in that means for separating and excluding foreign matter is formed at the bottom of the conveyance path.

Further, according to the present invention, there is provided, in a conveyance equipment having a conveyance path which serves to convey paper or the like, and an introduction path which merges with the conveyance path, for guiding to the conveyance path the paper or the like to be introduced into the conveyance system, wherein the paper or the like is conveyed in a state in which it is erected within the conveyance path while being sandwiched in between conveyance members; a conveyance equipment for paper or the like characterized in that a hole for dropping foreign matter is formed in the bottom of the portion where the conveyance path and the introduction path merge.

The conveyance path is defined by alternately arranging conveyance guide members and merging guide members which are connected with the introduction path, the merging guide members constituting the merging portion. The bottom of an upper stream end of each merging guide member is located below the bottom of a lower stream end of the corresponding conveyance guide member arranged upstream of each merging guide member, and the hole is formed in that part of the bottom of each merging guide member which is near the underneath of the lower stream end of the corresponding conveyance guide member.

The paper or the like, such as a bank note, inserted into the introduction path is guided from the introduction path to the conveyance path and is conveyed in the state in which it is erected within the conveyance path while being sandwiched in between the conveyance members, such as a belt and a roller.

When granules of an abrasive or the like exist on the conveyance path, the paper or the like moving within the conveyance path drops and expels the granular matter from the hole which is formed in the bottom of the next merging portion.

In the case where the bottom of the merging guide member is located below that of the conveyance guide member arranged upstream of this merging guide member, the paper or the like is conveyed without being caught in the hole of the merging portion.

Further, according to the present invention, there is provided a paper money collection system for a game island where game machines are juxtaposed, wherein bank note collection means is installed on one side of the end of the game island, while bank note conveyance belts which run in directions opposite to each other are disposed so as to fall into a communicating state which terminates on the other side of the end of the game island. The lower stream side of one of the bank note conveyance belts is connected so as to join the machine for exchanging a large denomination note. Bank note identification machines are disposed in association with individual bank note throwing slots arranged near the respective game machines and are mounted inside the respective bank note throwing slots so as to join said bank note conveyance belts. The conveyance equipment is installed having a conveyance path which serves to convey a bank note, and an introduction path which extends inwards from each bank note throwing slot and merges with the conveyance path to guide the paper or like to the conveyance path and so introduce it into the conveyance system, wherein the paper or the like is conveyed in a state in which it is erected within the conveyance path while being sandwiched in between conveyance members. The equipment is further formed with means for separating and ejecting foreign matter at the bottom of the conveyance path. The bank note identification machines are mounted aslant to, or in parallel with, the extending direction of each bank note conveyance belt.

Also, the bank note collection means can be constructed as an exchange machine for changing a large denomination note.

In this way, the bank notes to be used for the individual game machines can be efficiently delivered from the respective bank note identification machines to the bank note conveyance belts, and all the bank notes can be sent from the single conveyance path to the large denomination note changing machine while meeting one another. Because the large denomination note changing machine is installed at the end of the game island, the bank notes can be recycled and used.

BEST MODES FOR CARRYING OUT THE INVENTION

Now, an embodiment of a conveyance equipment according to the present invention will be described with reference to the drawings. By way of example, there will be explained a case where paper or the like to be conveyed is paper money or bank notes.

Figure 1:
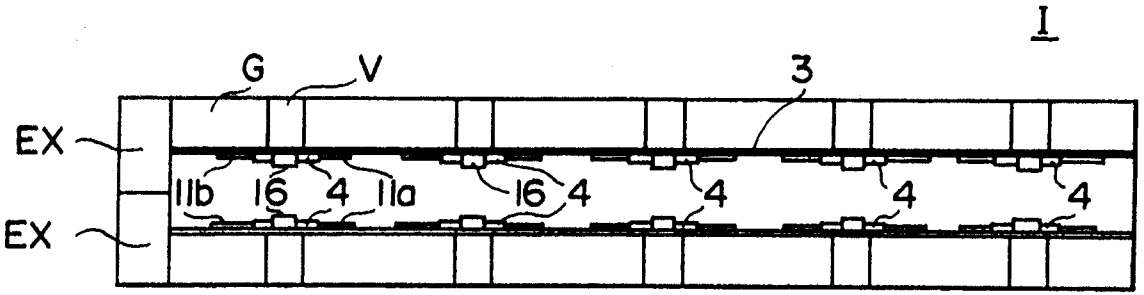
FIG. 1 is a schematic plan view showing a game island to which a conveyance equipment according to the present invention is applied.

In a game parlor, vending machines V for dispensing a game medium are installed between the respectively adjacent game machines G as shown in FIG. 1. The conveyance equipment for the paper or the like is connected to the rear sides of the game medium vending machines V, and it is used for accepting the bank notes from these machines and then conveying them to a paper money receiving box S through a conveyance path. In general, the conveyance equipment is arranged with its lengthwise direction held horizontal and its widthwise direction held vertical.

Figure 2:
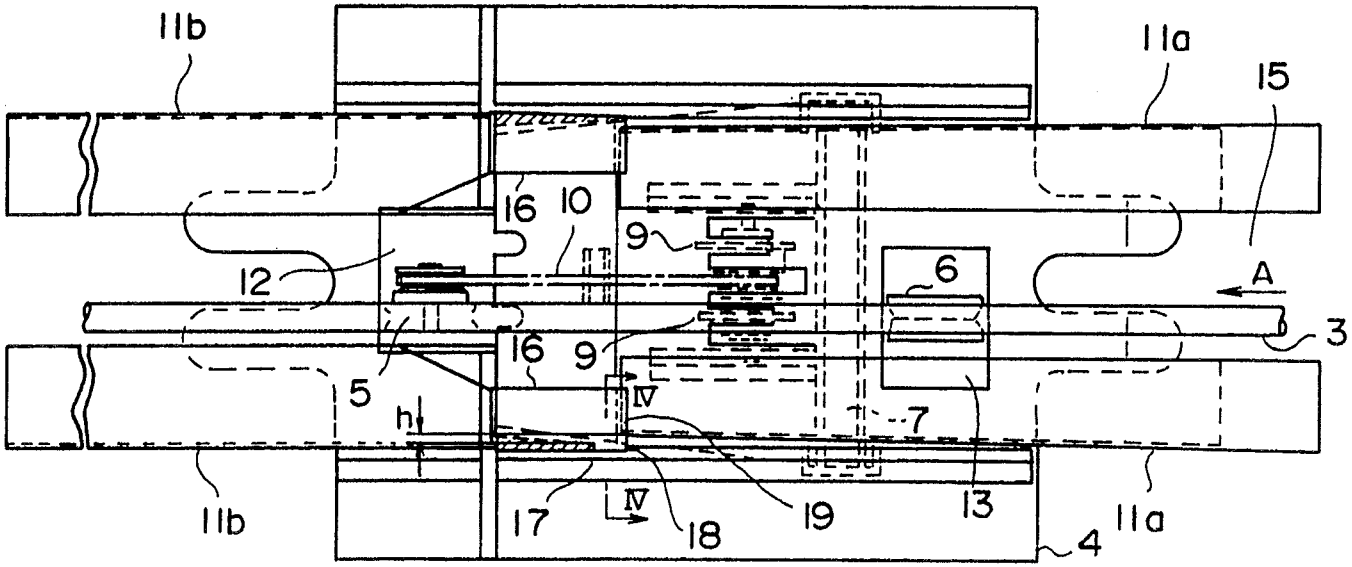
FIG. 2 is an elevational view showing the conveyance equipment of the present invention.
Figure 3:
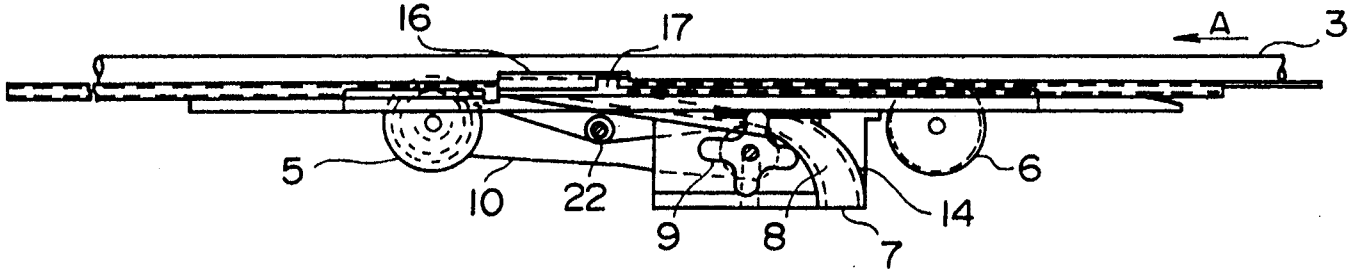
FIG. 3 is a cross-sectional view of the conveyance equipment in FIG. 2.

As shown in FIG. 2, the conveyance equipment has such a unit construction that a base 4 constitutes one unit and that a plurality of units in lengthwise succession constitute this conveyance equipment. On one surface of the base 4, two conveyance guide members 11*a* are provided in a manner spaced in the widthwise direction, and other conveyance guide members 11*b* are provided downstream of the conveyance guide members 11*a* in a spaced manner. The conveyance guide members 11*a*, 11*b* have deep grooves which confront each other in the widthwise direction, and between which the conveyance path 15 for conveying the paper money is defined.

A belt 3 is endlessly wound round the base 4 in the lengthwise direction thereof, at a position intermediate between the pairs of conveyance guide members 11*a*, 11*b* which extend in the lengthwise direction of the base 4. The base 4 is formed with openings 12, 13, in which a conveyance roller 5 and an upper stream side feed roller 6 are respectively arranged so that their peripheral surfaces may guide the belt 3 in contact therewith. The belt 3, conveyance roller 5 and upper stream side feed roller 6 constitute conveyance means for the bank note. The conveyance means conveys the bank note in the state in which this bank note is held in sandwiched fashion and is erected within the conveyance path 15.

The belt 3 is normally revolved in the direction of an arrow A by a power source (not shown). The bank note is conveyed downstream within the conveyance path 15 in the sandwiched state by the belt 3, conveyance roller 5 and upper stream side feed roller 6 until it is received in the paper money receiving box (S in FIG. 1) installed at the end part of a game system.

The base 4 has an introduction member 14 connected thereto at a position intermediate between the conveyance guide members 11*a* and 11*b*. The introduction member 14 has an introduction path 8. One end of the introduction path 8 forming a bank note intake port 7 is joined with the game medium vending machine (V in FIG. 1), while the other end thereof is joined to the conveyance path 15. The introduction path 8 merges with the conveyance path 15, and guides the bank note thereto. Star wheels 9 for propelling the bank note toward the base 4 are arranged in the introduction path 8.

The star wheels 9 are rotated by a timing belt 10 which is driven by the conveyance roller 5. A tension pulley 22 is disposed in contact with the outer side of the timing belt 10 at a position intermediate between the star wheels 9 and the conveyance roller 5.

Figure 5:
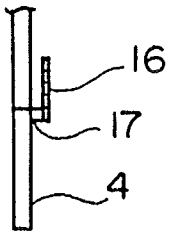
FIG. 5 is a partial sectional view showing a merging guide member in FIG. 2.
Figure 4:
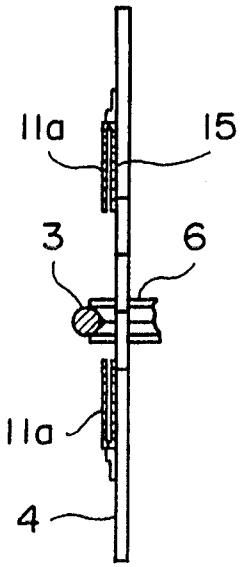
FIG. 4 is a vertical sectional view of the upper stream side of the conveyance equipment in FIG. 2.

In addition, the connection part among the introduction member 14 and the conveyance guide members 11*a*, 11*b* is formed with two, upper and lower merging guide members 16 unitary with the base 4, as shown by a section in FIG. 5. The merging guide members 16 define the merging portion between the conveyance path 15 and the introduction path 8. These merging guide members 16 are respectively formed with deep grooves in a manner to be spaced from each other in the widthwise direction of the base 4, and a hole 17 for dropping granular matter is provided in the bottom of the merging guide member 16 located on the lower side of the base 4.

Each of the merging guide members 16 has the bottom surface of its upper stream end 18 arranged below the bottom surface of the lower stream end 19 of the conveyance guide member 11*a* located upstream of the pertinent member 16, so that a level difference h is involved between the bottom surfaces of the upper stream end 18 and the lower stream end 19. The hole 17 of the merging guide member 16 lies at the bottom part thereof near under the lower stream end 19 of the conveyance guide member 11*a*.

The conveyance equipment has the merging guide members 16 arranged downstream of the conveyance guide members 11*a*, and has the conveyance guide members 11*b* arranged downstream of the members 16. The conveyance path 15 is defined by alternately arranging the conveyance guide members and the merging guide members 16.

Next, the operation of the equipment will be described.

When a bank note is inserted from the game medium vending machine into the bank note intake port 7 of the introduction member 14, it is sent from the introduction path 8 into the conveyance path 15 by the star wheels 9 which are rotated in the introduction path 8 by the conveyance roller 5 and the timing belt 10. The bank note is sent toward the conveyance guide members 11*b* on the lower stream side while being guided by the merging guide members 16, in the state in which it is erected within the conveyance path 15 with both its surfaces sandwiched in between the driven upper stream side feed roller 6 and belt 3.

Likewise, a bank note sent from the upper stream of the conveyance guide members 11*a* by these members is carried to the conveyance guide members 11*b* by the feed roller 5 immediately after having passed the merging guide members 16.

In this case, when the granules of an abrasive or the like are adherent to the game medium for any reason, e.g., due to electrostatic charges, they are expelled so that they only occasionally intrude into the conveyance path 15 corresponding to the upper stream conveyance guide members 11*a*. On this occasion, the bank note which is carried from the upper stream to the conveyance guide members 11*a* is conveyed while pressing the granular matter at its lower end. Then, when the bank note has approached the merging members 16, it drops and expels the granular matter downwards from the conveyance guide members 11*a* and through the holes 17 of the merging members 16.

Thereafter, the bank note is carried to the conveyance guide members 11*b* by the feed roller 5. In the course of the bank note being conveyed from the conveyance guide members 11*a* toward the merging guide members 16, it is not caught in the hole 17 owing to the level difference h based on the fact that the bottom surface of the upper stream end 18 of each merging guide member 16 is located below the bottom surface of the lower stream end 19 of the corresponding conveyance guide member 11*a*.

The granular matter which has intruded into the path corresponding to the lower stream conveyance guide members 11*b* are carried while being pressed by the lower end of the bank note, in the same manner as in the case of the conveyance guide members 11*b*. Near the merging members 16, the granules are dropped and expelled downwards from the conveyance guide members 11*a* and through the holes 17 of the merging members 16.

In the above embodiment, the foreign matter such as granular matter is dropped and expelled through the holes which are provided in the bottom of the merging portion. However, a position where the means for excluding the foreign matter such as granular matter is not restricted to the bottom of the merging portion, but it may be anywhere within the conveyance path. Moreover, the exclusion means may have any construction as long as it can separate the foreign matter such as granular matter from the object to-be-conveyed such as paper money. Specifically, apart from the holes, discontinuous parts such as net-like parts can be provided in the bottom so as to form foreign matter exclusion paths which diverge from the conveyance path.

Incidentally, although the conveyance equipment for paper money has been exemplified in the above embodiment, the conveyance equipment of the present invention can be used for conveying, not only paper money, but also other paper items including, e.g., post cards or cheques.

Figure 6:
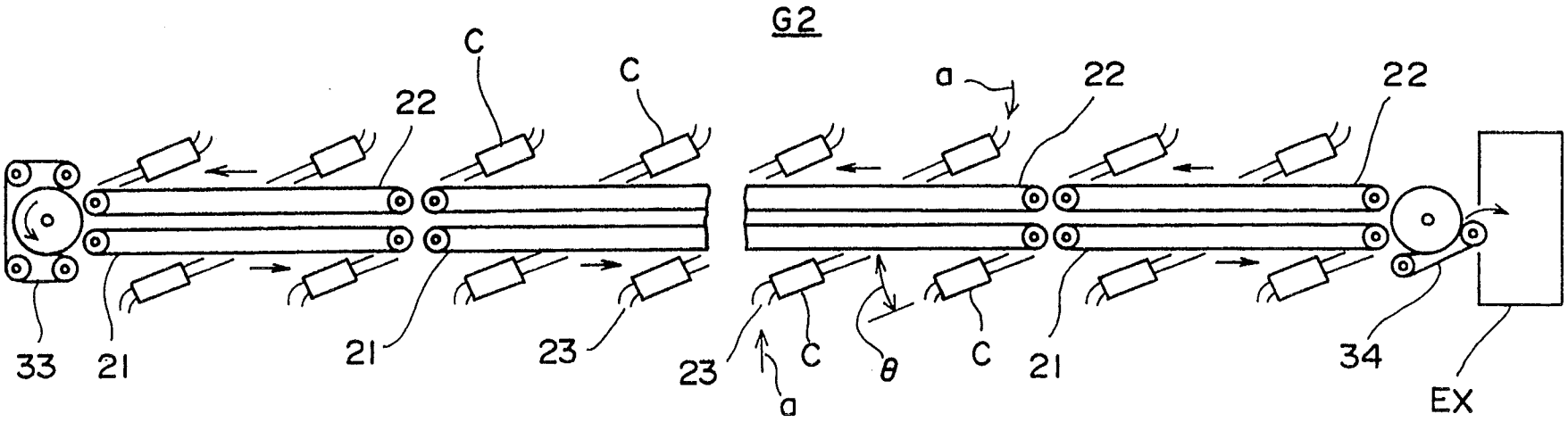
FIG. 6 is a schematic plan view showing a paper money collection system according to the present invention.
Figure 7:
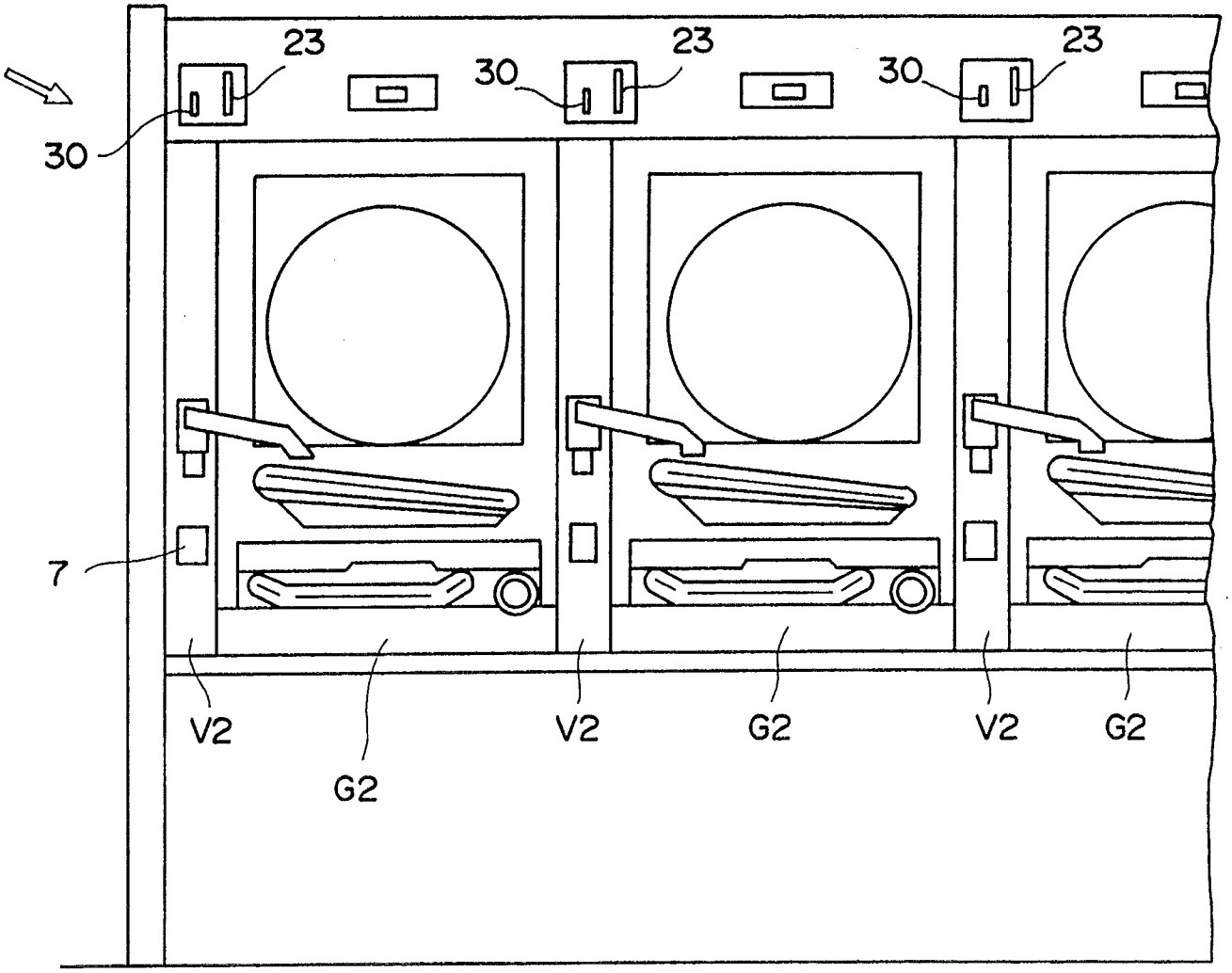
FIG. 7 is a front view showing a part of a game island to which the paper money collection system in FIG. 6 is applied.
Figure 8:
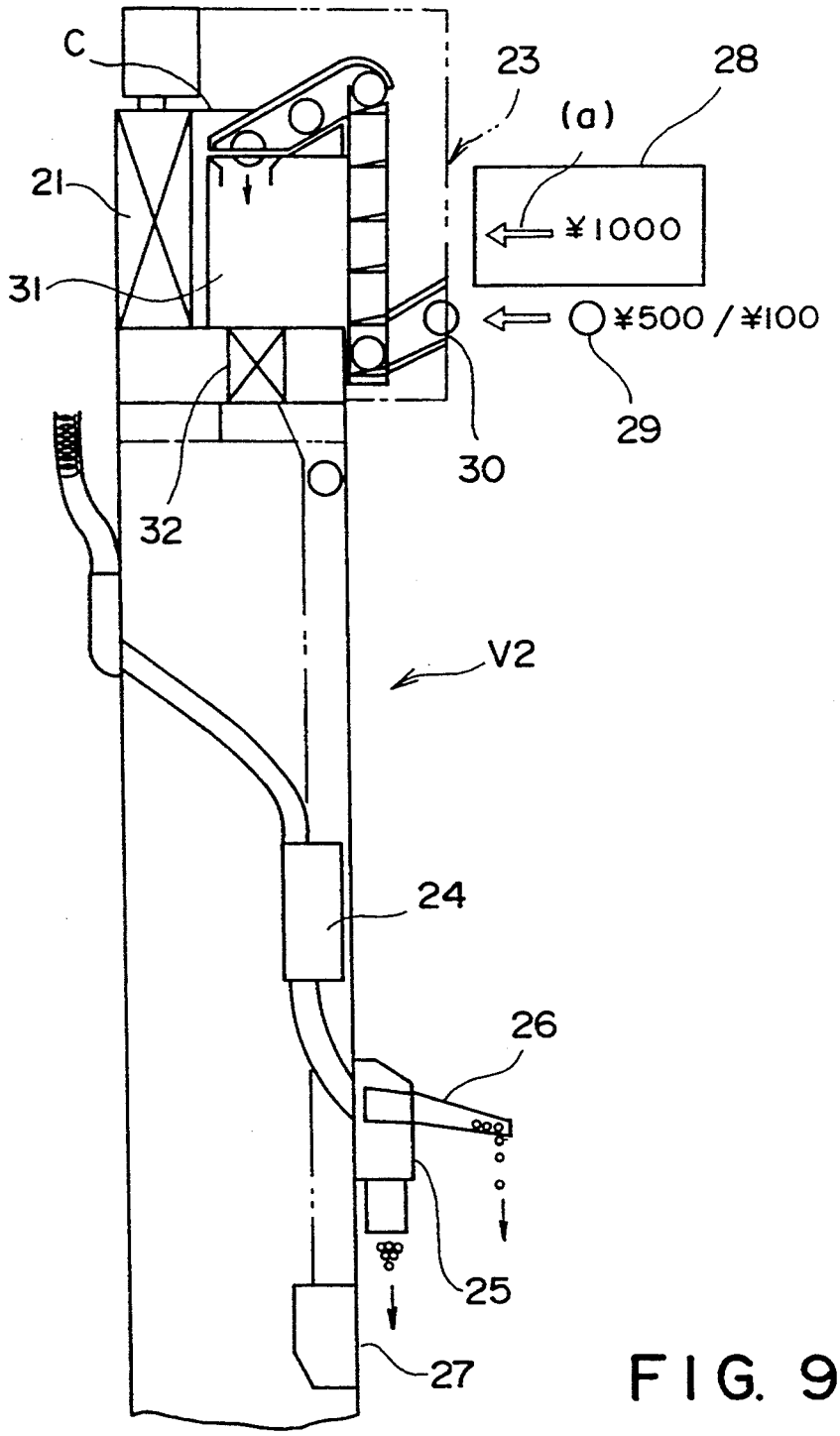
FIG. 8 is a sectional view showing a bank note identification machine in the game island depicted in FIG. 7.

Now, examples of a paper money collection system to which the foregoing conveyance equipment is applied will be described with reference to FIGS. 6–9. FIG. 7 shows a part of that game island I being a "pachinko" island within a parlor in which a large number of game machines G2 being "pachinko" machines are installed in juxtaposition. Ball vending machines between the game machines, V2 each of which includes a ball counter 24, a ball pot 25, a nozzle 26, a coin returning port 27, etc. are respectively interposed between the adjacent game machines G2. Besides, a bank note inserting slot 23 for a 1,000-yen note 28 and a coin inserting slot 30 into which a 500-yen or 100-yen coin 29 can be inserted are respectively provided in the upper part of each vending machine between the game machines, V2, while a coin selector 31 and a coin conveyor 32 for the coins are disposed inside each vending machine. An exchange machine for a large denomination note, EX into which the 10,000-yen note can be inserted so as to be changed for 1,000-yen notes is installed on one end side of the game island I.

Bank note conveyance belts 21, each of which can convey the bank note 28 toward the large denomination note exchange machine EX, are disposed in alignment on the rear side of one row of the game machines G2 being the inner side of the game island I. Also, bank note conveyance belts 22, each of which can convey the bank note 28 while traveling in the opposite direction to the traveling direction of the bank note conveyance belt 21, are disposed in alignment on the rear side of the other row of the game machines G2 so as to lie near the bank note conveyance belts 21 in parallel therewith. A relay belt 33, which can relay the bank note 28 from the bank note conveyance belt 22 to the bank note conveyance belt 21 while diverting the flowing direction of this bank note, is extended on the end side of the game island I remote from the exchange machine. A feed belt 34 is interposed between the terminal side of the aligned bank note conveyance belts 21 and the exchange machine EX for the large denomination note.

In addition, bank note identification machines C, each of which can identify the bank note 28, for example, confirm the denomination and integrity of the paper money and then deliver this bank note to the belt side, are respectively interposed between the inner ends of the individual bank note insertion slots 23 and the bank note conveyance belts 21 and 22. Herein, the bank note identification machines C are arranged inclining at an angle $\theta$ downstream relative to the extending direction of the bank note conveyance belts 21, 22 as illustrated in FIG. 6, or they are arranged in parallel with the above extending direction.

Accordingly, when the bank notes 28 are inserted into the bank note insertion slots 23 as indicated by arrows a in order to obtain "pachinko" balls, they are efficiently delivered to the bank note conveyance belts 21, 22 while being identified by the bank note identification machines C. The bank note 28 delivered to the bank note conveyance belt 22 has its flowing direction diverted and is relayed to the bank note conveyance belt 21 by the relay belt 33, while the bank note 28 delivered to the bank note conveyance belt 21 is joined with the bank note 28 conveyed from the upper stream. In this manner, all the bank notes 28 are conveyed as indicated by arrows in FIG. 6, whereupon they are delivered from the feed belt 34 into the large denomination note exchange machine EX so as to be stocked therein. Thus, the large denomination note exchange machine EX permits the bank notes to be recycled and used.

Figure 9:
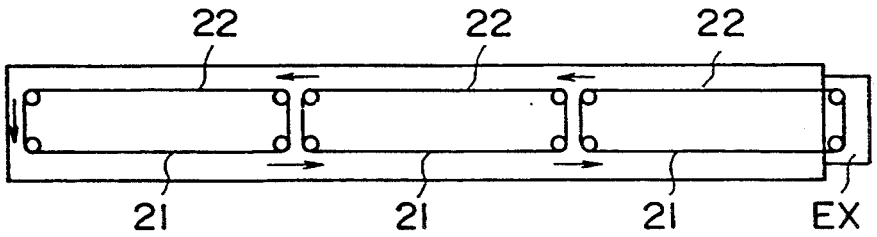
FIG. 9 is a schematic view showing another example of a paper money collection system.

FIG. 9 shows another example, which is so constructed that both the confronting bank note conveyance belts 21, 22 are formed of a single belt.

As described above, according to the present invention, bank notes to be bet for the respective game machines of a game island can be efficiently delivered from corresponding bank note identification machines to bank note conveyance belts. Moreover, all bank notes to be bet in the game island can be favorably fed from one conveyance path to a large denomination note exchange machine while being joined, and they can be recycled and effectively used owing to the large denomination note exchange machine installed at the end of the game island. Furthermore, the bank note conveyance belts and the bank note identification machines can be arranged in a simple scheme, and the island can be prevented from widening, to bring forth the advantages that the game islands can be efficiently installed within a parlor and that the work of the installation is facilitated.

We claim:

1. A conveyance equipment having a conveyance path which serves to convey paper strips, and an introduction path which merges with the conveyance path for guiding paper strips to the conveyance path, wherein the paper strips are conveyed erect within the conveyance path while being sandwiched between conveyance members provided therein:

at least one hole formed bottom of said conveyance path for excluding therethrough and out of the conveyance equipment any foreign matter that may have entered the conveyance path.

2. A conveyance equipment as defined in claim 1, wherein:

said at least one hole is formed at a location where said conveyance path and said introduction path merge.

3. A conveyance equipment as defined in claim 1, wherein:

said conveyance path is defined by an arrangement of alternating and cooperating conveyance guide members and merging guide members which are connected with said introduction path, said merging guide members providing a merging portion; and a bottom of an upstream end of each of said merging guide members is located below a bottom of a downstream end of a corresponding conveyance guide member located upstream of said merging guide member, the at least one hole being formed in a part of the bottom of said merging guide member which is close to and under the downstream end of the corresponding conveyance guide member located upstream thereof.

4. A conveyance equipment as defined in claim 2, wherein:

said conveyance path is defined by an arrangement of alternating and cooperating conveyance guide members and merging guide members, said merging guide members providing a merging portion; and a bottom of an upstream end of each of said merging guide members is located below a bottom of a downstream end of a corresponding conveyance guide member located upstream of said merging guide member, the at least one hole being formed in a part of the bottom of said merging guide member which is close to and under the downstream end of the corresponding conveyance guide member located upstream thereof.

5. A paper money collection system for a game island where game machines are juxtaposed, comprising:

bank note collection means installed at one end of said game island;

bank note conveyance belts, which run in directions opposite to each other and along the length of the game island, disposed so as to be in a communicating state at another end of said game island;

bank note identification machines respectively mounted inside individual bank note insertion slots provided near the respective game machines the bank note insertion slots being formed so as to join said bank note conveyance belts; and conveyance equipment having a conveyance path comprising conveyance members which serve to convey a bank note received from one of the bank note insertion slots, and an introduction path which extends inwards from each of said bank note insertion slots and merges with said conveyance path, for guiding to said conveyance path the bank note introduced into the conveyance system, wherein the bank note is conveyed in a state in which it is erect within said conveyance path while being sandwiched between said conveyance members, and said equipment is formed with means for separating and excluding any incidental foreign matter conveyed with said bank notes via a bottom of said conveyance path so as to exclude said foreign matter from the money collection system.

6. A paper money collection system according to claim 5, wherein:

said bank note identification machines are mounted either aslant to or in parallel with a respective extending direction of each of said bank note conveyance belts.

* * * * *